US011802407B2

(12) United States Patent
Jankovec

(10) Patent No.: US 11,802,407 B2
(45) Date of Patent: Oct. 31, 2023

(54) SUSPENDED DRYWALL CEILING GRID SYSTEM SUPPORT MEMBERS

(71) Applicant: Rockwool International A/S, Hedehusene (DK)

(72) Inventor: Scott G. Jankovec, Elmhurst, IL (US)

(73) Assignee: ROCKWOOL A/S, Denmark (DK)

( * ) Notice: Subject to any disclaimer, the term of this patent is extended or adjusted under 35 U.S.C. 154(b) by 157 days.

(21) Appl. No.: 17/533,755

(22) Filed: Nov. 23, 2021

(65) Prior Publication Data

US 2023/0160203 A1 May 25, 2023

(51) Int. Cl.

| | |
|---|---|
| ***E04B 9/06*** | (2006.01) |
| ***E04B 9/24*** | (2006.01) |
| ***E04B 9/12*** | (2006.01) |
| ***E04B 9/10*** | (2006.01) |

(52) U.S. Cl.
CPC ..... *E04B 9/068* (2013.01); *E04B 9/10* (2013.01); *E04B 9/127* (2013.01); *E04B 9/245* (2013.01)

(58) Field of Classification Search
CPC ..... E04B 9/068; E04B 9/10; E04B 9/127; E04B 9/245
See application file for complete search history.

(56) References Cited

U.S. PATENT DOCUMENTS

| | | | | |
|---|---|---|---|---|
| 2,924,311 | A | 2/1960 | Brown | |
| 3,221,466 | A | 12/1965 | Downing, Jr. et al. | |
| 3,284,977 | A | 11/1966 | Lickliter et al. | |
| 3,399,915 | A | 9/1968 | Stanzak | |
| 3,745,734 | A * | 7/1973 | Davey et al. | E04F 19/062 52/471 |
| 3,749,346 | A * | 7/1973 | Cherniak | F16B 2/248 248/302 |
| 3,828,508 | A * | 8/1974 | Moeller | E04B 9/245 52/764 |
| 3,890,760 | A | 6/1975 | Jones | |
| 3,898,784 | A | 8/1975 | Sauer et al. | |
| 3,921,363 | A | 11/1975 | Beynon | |
| 3,928,950 | A | 12/1975 | Beynon | |
| 3,979,874 | A | 9/1976 | Cubbler et al. | |
| 4,108,563 | A | 8/1978 | Brown et al. | |
| 4,161,856 | A | 7/1979 | Brown et al. | |
| 4,206,578 | A * | 6/1980 | Mieyal | E04B 9/068 52/506.07 |

(Continued)

FOREIGN PATENT DOCUMENTS

| | | | |
|---|---|---|---|
| CA | 2373235 | A1 | 8/2002 |
| CA | 2730283 | C | 6/2016 |

(Continued)

OTHER PUBLICATIONS

International Search Report & Written Opinion from related PCT/EP2022/082734, dated Mar. 17, 2023.

*Primary Examiner* — Rodney Mintz
(74) *Attorney, Agent, or Firm* — Cook Alex Ltd.

(57) ABSTRACT

A support member for a suspended drywall ceiling grid system includes a central web formed of two layers of sheet metal having first and second ends, a reinforcement bulb extending from an upper portion of the central web between the first and second ends, opposed flanges extending from a lower portion of the central web between the first and second ends, first and second end connectors integral with the central web and extending from the first and second ends of the central web, respectively, past the flanges, each of the opposed flanges having an upper surface and a knurled lower surface between the central web and a rolled edge portion, and each rolled edge portion having an initial region tilted downward and outward and extending into a curved region, wherein the curved region is rolled upward and inward and terminates in an outer edge toward the initial region.

11 Claims, 14 Drawing Sheets

(56) References Cited

U.S. PATENT DOCUMENTS

| | | | | |
|---|---|---|---|---|
| 4,264,231 | A | 4/1981 | Rosenbaum | |
| 4,314,432 | A | 2/1982 | Rosenbaum | |
| RE31,528 | E * | 3/1984 | Mieyal | E04B 9/068 52/506.07 |
| 4,505,083 | A * | 3/1985 | Mieyal | E04B 9/122 52/506.07 |
| 4,520,609 | A * | 6/1985 | Worley et al. | E04B 9/067 52/506.07 |
| 4,525,973 | A | 7/1985 | Vukmanic et al. | |
| 4,611,453 | A | 9/1986 | Worley | |
| 4,685,262 | A | 8/1987 | Meredith, Jr. | |
| 4,691,494 | A * | 9/1987 | Gwynne | E04C 3/09 52/842 |
| 4,723,749 | A | 2/1988 | Carraro et al. | |
| 4,730,433 | A | 3/1988 | Ollinger et al. | |
| 4,989,387 | A | 2/1991 | Vukmanic et al. | |
| 5,044,138 | A | 9/1991 | Zaccardelli et al. | |
| 5,271,202 | A | 12/1993 | Vukmanic et al. | |
| 5,421,132 | A | 6/1995 | Bischel et al. | |
| 5,771,653 | A * | 6/1998 | Dolati et al. | E04C 3/11 52/696 |
| 5,839,246 | A | 11/1998 | Ziegler et al. | |
| 6,205,733 | B1 | 3/2001 | LaLonde | |
| 6,722,098 | B2 | 4/2004 | Platt | |
| 6,729,100 | B2 | 5/2004 | Koski et al. | |
| 7,478,787 | B2 | 1/2009 | Bankston et al. | |
| 7,614,195 | B2 | 11/2009 | Platt et al. | |
| 7,752,821 | B2 | 7/2010 | Jankovec et al. | |
| 7,770,349 | B2 | 8/2010 | Tedesco et al. | |
| 7,975,448 | B2 | 7/2011 | Jahn et al. | |
| 8,056,294 | B2* | 11/2011 | LaLonde | E04B 9/06 52/774 |
| 8,117,793 | B2 | 2/2012 | Jankovec et al. | |
| 8,359,801 | B2* | 1/2013 | Lehane, Jr. et al. | E04B 9/068 72/206 |
| 8,359,803 | B2* | 1/2013 | Lehane, Jr. et al. | B21D 22/02 52/506.1 |
| 8,359,812 | B2* | 1/2013 | Raheel et al. | B21D 22/02 52/506.1 |
| 8,397,462 | B2 | 3/2013 | Gulbrandsen et al. | |
| 8,485,835 | B2 | 7/2013 | Liang et al. | |
| 8,590,248 | B2* | 11/2013 | Lehane, Jr. et al. | E04B 9/241 52/506.07 |
| 10,106,982 | B2 | 10/2018 | Corpolongo | |
| 2007/0028554 | A1 | 2/2007 | Ferrell et al. | |
| 2008/0148668 | A1 | 6/2008 | Jahn et al. | |
| 2008/0155935 | A1 | 7/2008 | Raheel et al. | |
| 2009/0293403 | A1 | 12/2009 | Cedrone et al. | |
| 2010/0139189 | A1* | 6/2010 | LaLonde | E04B 9/26 52/220.6 |
| 2010/0257807 | A1 | 10/2010 | Raheel et al. | |
| 2011/0078968 | A1 | 4/2011 | Ferrell et al. | |
| 2012/0023854 | A1* | 2/2012 | Lehane, Jr. et al. | B21D 5/08 52/506.07 |
| 2012/0291388 | A1* | 11/2012 | Lehane, Jr. et al. | E04B 9/068 52/506.07 |
| 2013/0276395 | A1* | 10/2013 | Lehane, Jr. et al. | E04B 9/068 72/206 |
| 2014/0331587 | A1 | 11/2014 | Dallan | |
| 2017/0350120 | A1 | 12/2017 | Czyzewicz et al. | |
| 2020/0378116 | A1 | 12/2020 | Jankovec | |

FOREIGN PATENT DOCUMENTS

| | | | |
|---|---|---|---|
| WO | 2010117517 | A2 | 10/2010 |
| WO | 2015145245 | A1 | 10/2015 |
| WO | 2018218312 | A1 | 12/2018 |

* cited by examiner

SUSPENDED DRYWALL CEILING GRID SYSTEM SUPPORT MEMBERS

BACKGROUND

The present invention relates to grid systems for ceilings and more particularly to suspended drywall ceiling grid system support members.

Suspended drywall ceilings typically require a support grid comprising a plurality of interconnected support members for installation of drywall sheets. The support members typically are of two types, which often are referred to as runners and cross tees. The runners and cross tees also may be referred to as beams, tees or grid tees, and typically have a generally inverted T-shape. A vertical web generally extends downward to opposed horizontal flanges. The flanges receive self-tapping drywall screws, to support drywall sheets. Connected lengths of the runners generally are arranged in a parallel and spaced apart configuration. The cross tees generally tend to be constructed similarly to the runners and arranged in a parallel and spaced apart configuration that is perpendicular to and spanning the distance between the runners.

The support members tend to be made in roll-forming operations in which a flat strip of sheet metal is sequentially deformed into an inverted T-shape. The support members may but need not be symmetrical in cross-section about a vertical axis. The opposed flanges may have a single flat layer of sheet metal, may have an outer portion of the flange bent backward onto itself to create a double thickness forming a hem, or the flanges may be covered by a cap, which provides a second layer of sheet metal across the flanges. Any of these configurations tend to include sharp sheet metal edges along the flanges, which present a hazard to an installer when grasping a support member.

Once the support members, including runners and cross tees are installed in an assembled, suspended configuration, a drywall installer brings a drywall sheet up to the grid for installation. However, the installer approaches from below the drywall sheet when seeking to install a screw to secure the drywall sheet to the grid. In such a position, the installer generally may not be able to see the support members that are above the drywall sheet. For proper and secure installation, a rotating self-tapping screw having a threaded shaft must pass through the drywall, engage and pierce one of the opposed flanges of the support member, and threadably draw the drywall upward against the support member. Unfortunately, the screw may engage the flange near an outer edge or wander on the flange toward the outer edge and tear through the outer edge, bend the outer edge of the flange upward without piercing the flange, or simply move off the outer edge of the flange without piercing and threadably engaging the flange.

SUMMARY

By way of the present disclosure, a suspended drywall ceiling grid system includes support members in the form of runners and cross tees that may be assembled or connected to each other in a grid to support panels, such as drywall sheets. The new support members provide a combination of structural features that provide enhancements.

The new support member structures provide for safer and more convenient handling of the runners and cross tees by preventing inadvertent contact with sharp sheet metal along the outer edges of the opposed flanges. The outer edges of the flanges are configured to advantageously provide the flanges with increased strength and resistance to upward bending, while also providing the support members increased overall rigidity. The new support member structures additionally provide screw stops, which reduce the potential for a self-tapping screw to wander, move off or tear through an outer edge of a flange. The unique screw stop flange structure provides a further benefit by alleviating a need for a cap or additional layer of sheet metal over the flanges. As a result, the support members advantageously are economical to manufacture, convenient and safer to handle, with screw stops that enhance the likelihood that a self-tapping screw will pierce and threadably penetrate a flange to securely connect a drywall sheet to the grid.

A support member in the form of a runner or cross tee of the present disclosure has a cross-section generally in the form of an inverted T-shape. A central web has a double thickness of sheet metal. A pair of drywall support flanges extend from a lower portion of the central web in opposite directions, and a reinforcing bulb extends from an upper portion of the central web.

In a first aspect, a support member for a suspended drywall ceiling grid system of the present disclosure includes a central web formed of two layers of sheet metal having first and second ends. A reinforcement bulb extends from an upper portion of the central web between the first and second ends. Opposed flanges extend from a lower portion of the central web between the first and second ends. First and second end connectors are integral with the central web and extend from the first and second ends of the central web, respectively, past the flanges. Each of the opposed flanges has an upper surface and a knurled lower surface between the central web and a rolled edge portion, and each rolled edge portion has an initial region tilted downward and outward and extends into a curved region, wherein the curved region is rolled upward and inward and terminates in an outer edge toward the initial region.

The first and second connectors on support members that are runners facilitate end-to-end attachment of a first runner to a second runner. The first and second connectors on support members that are cross tees similarly facilitate end-to-end attachment of a first cross tee to a second cross tee, and such end connectors on cross tees are configured to connect to a runner by extending through an aperture in the runner.

The first end connector of a support member is displaced out of a plane defined by the central web in a first direction and the second end connector is displaced out of the plane defined by the central web in a second direction opposite to the first direction, with each of the first and second end connectors having a distal edge. A strap adjacent each end of the central web is deformed out of the plane defined by the central web in a direction opposite to the adjacent end connector. Each strap is configured to receive an end portion of an end connector of a similar support member.

Other features and advantages will become apparent upon reference to the drawings and detailed description.

BRIEF DESCRIPTION OF THE DRAWINGS

In describing the preferred embodiments, reference is made to the accompanying drawing figures wherein like parts have like reference numerals, and wherein.

Figure 1:
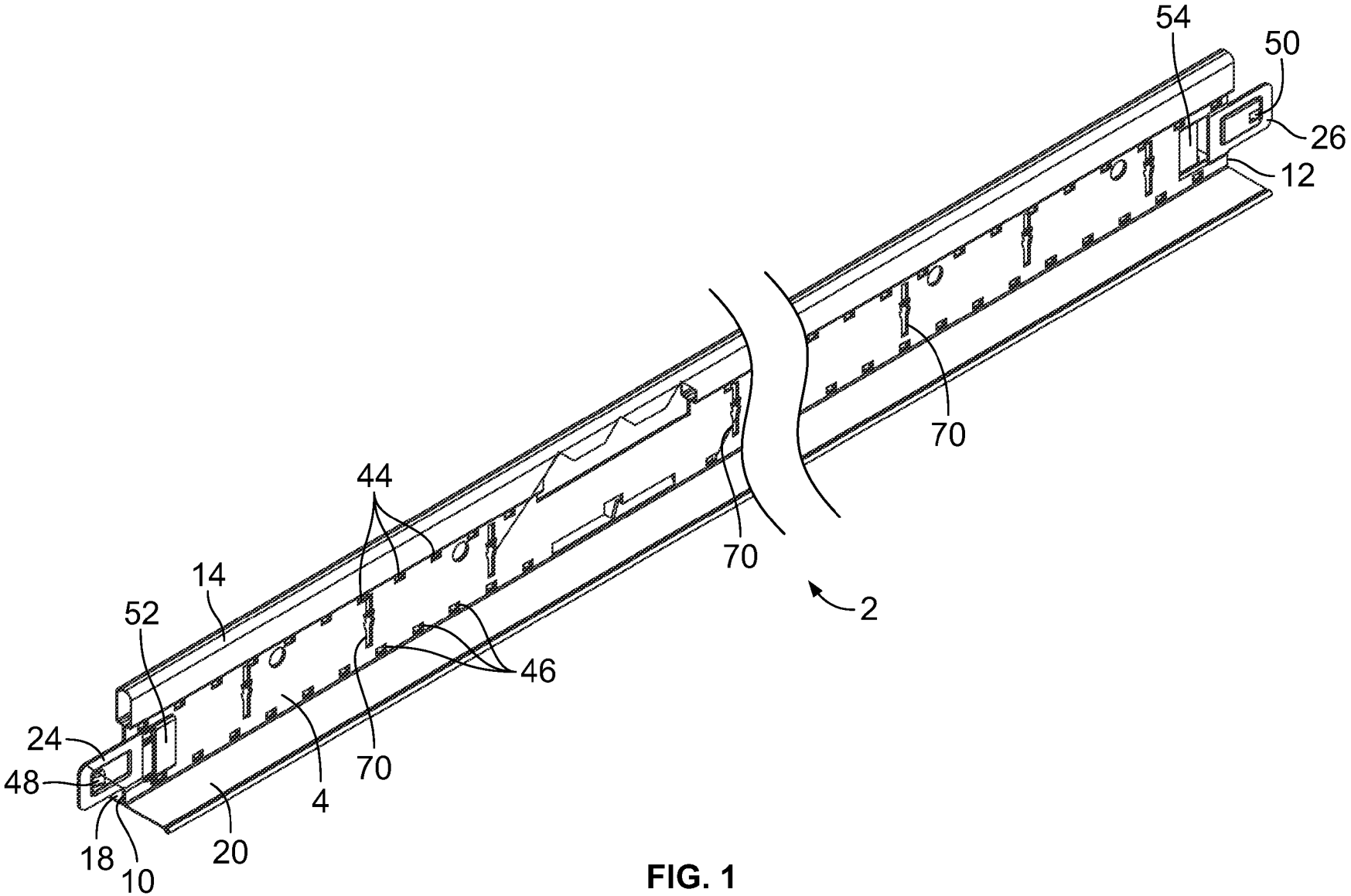
FIG. 1 is a perspective side view of a first example support member for a suspended drywall ceiling grid system in the form of a runner in accordance with the present disclosure.
Figure 2:
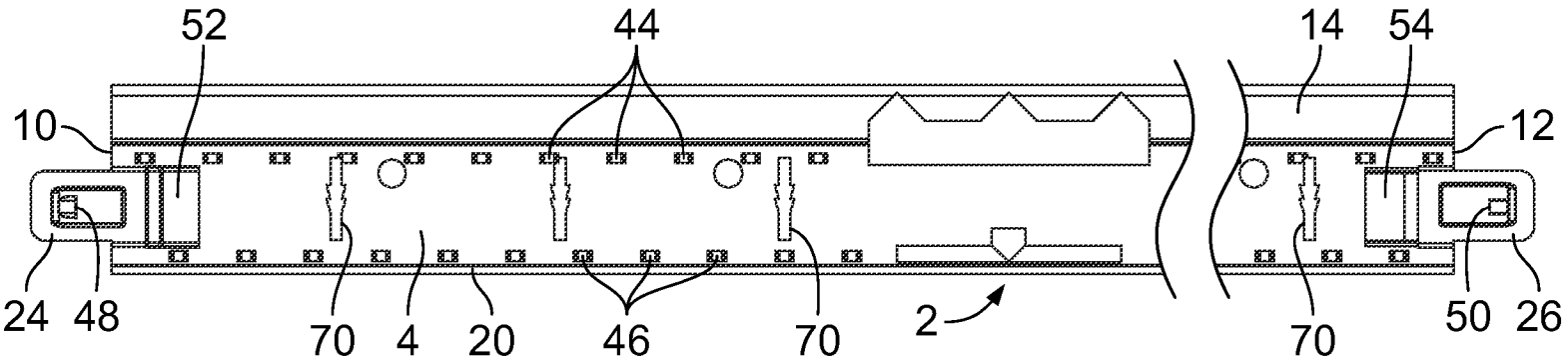
FIG. 2 is a side view of the first example support member of FIG. 1.
Figure 3:
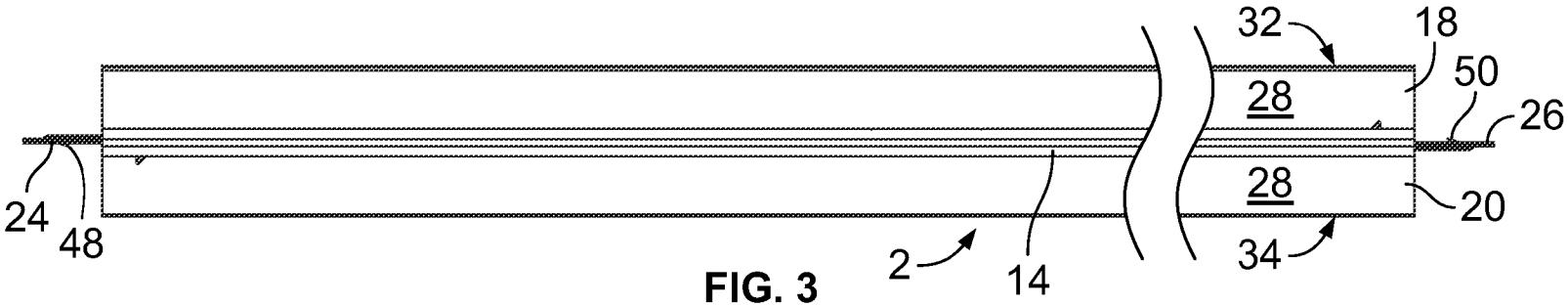
FIG. 3 is a top view of the first example support member of FIG. 1.
Figure 4:
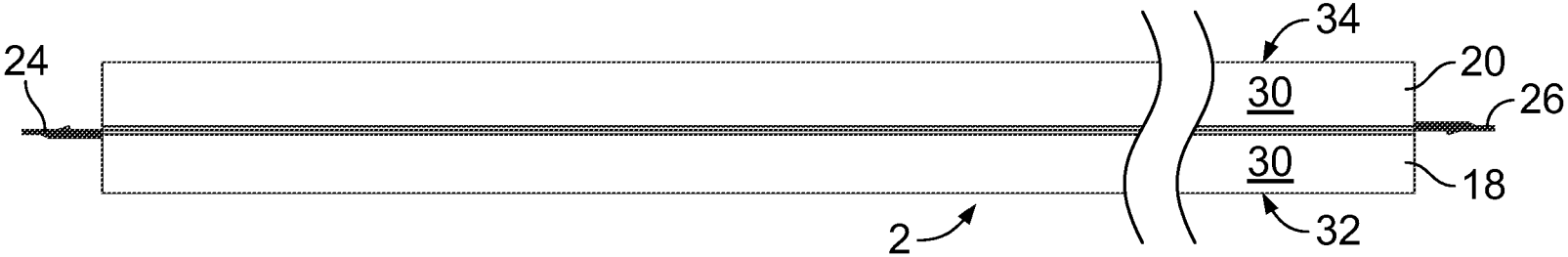
FIG. 4 is a bottom view of the first example support member of FIG. 1.
Figure 6:
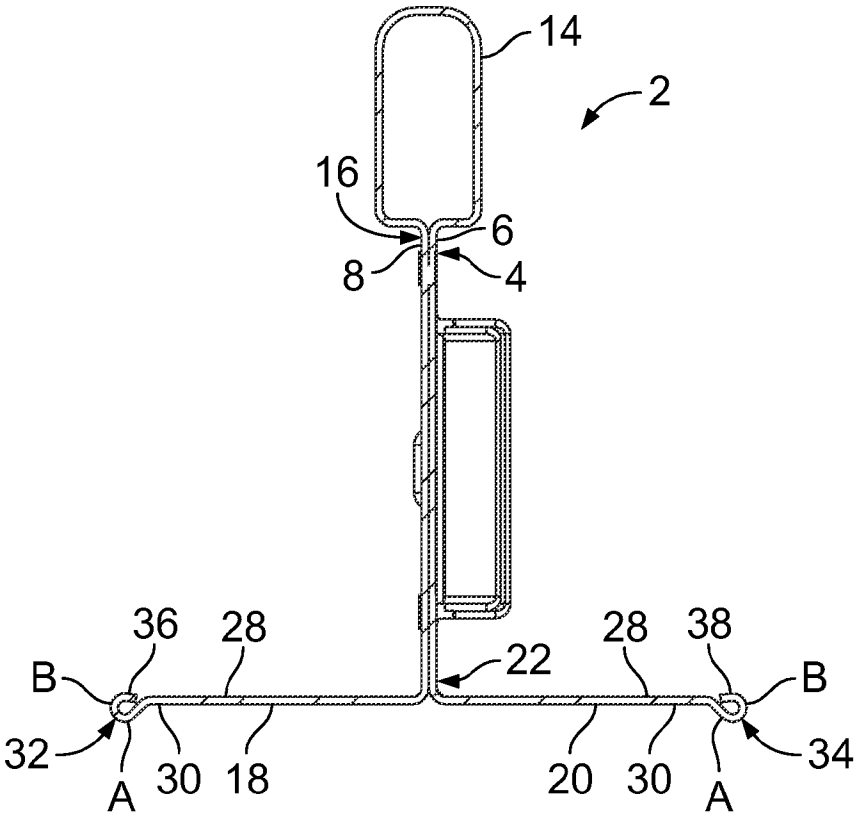
FIG. 6 is a cross-sectional view of the first example support member of FIG. 1.
Figure 5:
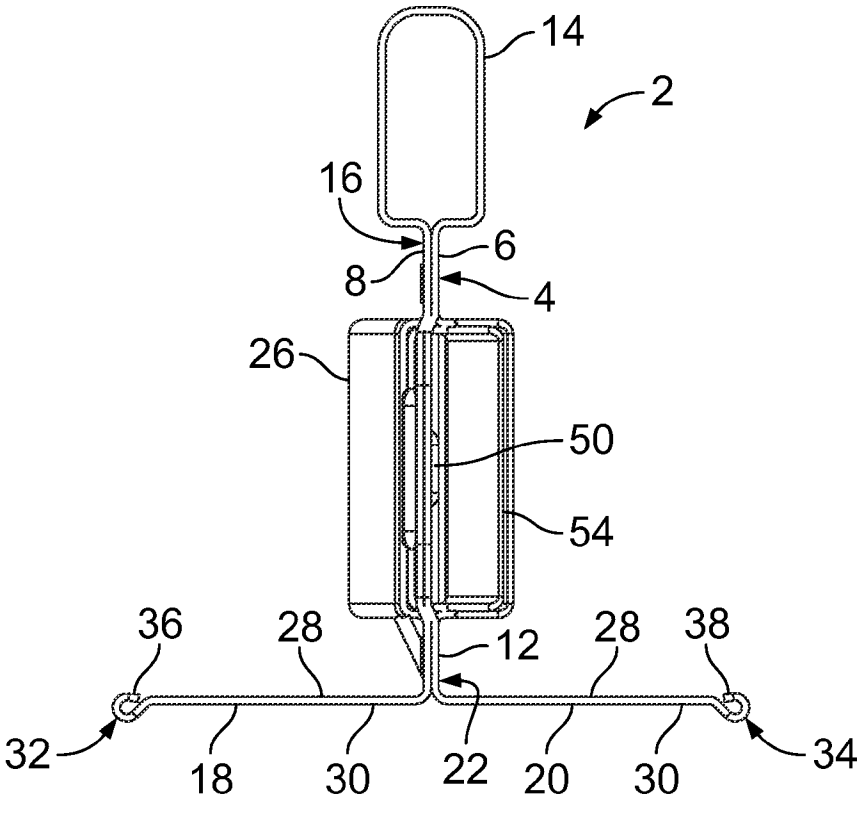
FIG. 5 is an end view of the first example support member of FIG. 1.

It should be understood that the drawings are not to scale. While some mechanical details of example support members for a suspended drywall ceiling grid system, including other plan and section views of the examples shown and of examples that may have alternative configurations, have not been included, such details are considered within the comprehension of those of skill in the art in light of the present disclosure. It also should be understood that the present invention is not limited to the example embodiments illustrated.

DETAILED DESCRIPTION

With reference to FIGS. 1-20, preferred embodiments of suspended drywall ceiling grid systems are provided. In FIG. 1-8*a*, a first example support member 2 for a suspended drywall ceiling grid system is shown. The first example support member 2 includes a central web 4 formed of two layers 6, 8 of sheet metal having first and second ends 10, 12. A reinforcement bulb 14 extends from an upper portion 16 of the central web 4 between the first and second ends 10, 12. Opposed flanges 18, 20 extend from a lower portion 22 of the central web 4 between the first and second ends 10, 12. First and second end connectors 24, 26 are integral with the central web 4 and extend from the first and second ends 10, 12 of the central web 4, respectively, past the flanges 18, 20. The central web 4 includes vertically extending apertures 70 that may receive end connectors of respective first and second cross tees 102, 102, as will be described further herein.

Each of the opposed flanges 18, 20 has an upper surface 28 and a knurled lower surface 30 between the central web 4 and a rolled edge portion 32; 34. Each rolled edge portion 32, 34 has an initial region A tilted downward and outward and extending into a curved region B, wherein the curved region B is rolled upward and inward and terminates in an outer edge 36, 38 toward the initial region A.

It will be appreciated that the first example support member 2 may be configured, for example, to be a runner for use in a suspended drywall ceiling grid system.

In FIGS. 9-14, a second example support member 102 for a suspended drywall ceiling grid system is shown. The second example support member 102 includes a central web 104 formed of two layers 106, 108 of sheet metal having first and second ends 110, 112. A reinforcement bulb 114 extends from an upper portion 116 of the central web 104 between the first and second ends 110, 112. Opposed flanges 118, 120 extend from a lower portion 122 of the central web 104 between the first and second ends 110, 112. First and second end connectors 124, 126 are integral with the central web 104 and extend from the first and second ends 110, 112 of the central web 104, respectively, past the flanges 118, 120. The central web 104 includes vertically extending apertures 170 that may receive end connectors of respective first and second cross tees 102, 102, as will be described further herein.

Each of the opposed flanges 118, 120 has an upper surface 128 and a knurled lower surface 130 between the central web 104 and a rolled edge portion 132, 134. Each rolled edge portion 132, 134 has an initial region A′ tilted downward and outward and extending into a curved region B′, wherein the curved region B′ is rolled upward and inward and terminates in an outer edge 136, 138 toward the initial region A′.

The second example support member 102 may be configured to be a cross tee, for example, for use with the first example support member 2 in the form of a runner in a suspended drywall ceiling grid system.

Thus, it will be appreciated that a support member may be a runner 2 or cross tee 102, which share many similarities in construction and configuration and may be configured to be connected together to form a grid system. As may be seen in FIGS. 9 and 10, the cross tee 102 includes raised portions 140, 142 at the ends of the flanges 118, 120. The raised portions 140, 142 near the ends of the flanges 118, 120 of the cross tee 102 may rest upon the flanges 18, 20 of respective runners 2 (or may rest upon the flanges 118, 120 of respective cross tees 102) to which the cross tees are connected. The raised portions 140, 142 help to present a common lower plane of the system grid, while also providing additional vertical support of the cross tees 102.

Each rolled edge portion 32, 34, 132, 134 of the respective flanges 18, 20, 118, 120 of the respective support members 2, 102 provides a screw stop. Structural rigidity, convenience and safety in handling the respective support member 2, 102 are established by having the curved region B, B′ of each respective rolled edge portion 32, 34, 132, 134 terminate in contact with the respective initial region A, A′. Protection from the respective sharp sheet metal outer edge 36, 38, 136, 138 of each respective flange 18, 20, 118, 120 also is facilitated by each respective rolled edge portion 32, 34, 132, 134 having a top of the respective curved region B, B′ generally coplanar with the respective upper surface 28, 128 of the respective flange 18, 20, 118, 120. The configuration of the respective rolled edge portion 32, 34, 132, 134 also provides for favorable mating of the upper surface of a drywall sheet to the respective lower surface 30, 130 of the respective flange 18, 20, 118, 120, with relatively little or no flange deformation occurring at screw locations.

Each respective support member 2, 102 has a cross-section generally in the form of an inverted T. Strength and rigidity are enhanced in each respective support member 2, 102 by a first row of longitudinally spaced stitches 44, 144 at the respective upper portion 16, 116 of the respective central web 4, 104 adjacent the respective bulb 14, 114 and a second row of longitudinally spaced stitches 46, 146 at the respective lower portion 22, 122 of the respective central web 4, 104 adjacent the respective flanges 18, 20, 118, 120, with the stitches 44, 144 in the first row being staggered relative to the stitches 46, 146 in the second row.

Each of the first and second end connectors 24, 26 of the support member 2 further includes a locking tab 48, 50. Each of the ends 10, 12 of the central web 4 further includes a strap 52, 54 deformed out of the plane defined by the central web 4 and being located adjacent the respective end connector 24, 26. It will be appreciated that when a similar support member 2 is placed in end-to-end engagement, the respective straps 52, 54 receive the respective end connectors 24, 26 and engage the respective locking tabs 48, 50. This is shown with respect to the support members 2 configured as runners.

In the alternative embodiment showing a support member 102 in the form of a cross tee, each of the first and second end connectors 124, 126 of the support member 102 further includes a tab 156, 158 extending in a first direction and being configured to engage the central web 4 of a separate perpendicularly disposed support member 2, or a central web 104 of a separate perpendicularly disposed support member 102. This may be best appreciated when viewing FIGS. 9 and 15-17. Each of the first and second end connectors 124, 126 of the support members 102 placed in end-to-end engagement further includes a locking tab 160, 162 extending in a second direction opposed to the first direction of the respective tabs 156, 158, and when said support member 102 and a similar support member 102 are placed in end-to-end engagement with the respective end connectors 124, 126 extending through an aperture 70 in a central web 4 of a separate perpendicularly disposed support member 2 (or through an aperture 170 in a central web 104 of a separate perpendicularly disposed support member 102), the respective locking tabs 160, 162 engage an edge of the area punched out to form tabs 156, 158. Thus, a runner 2 having an aperture 70 through the central web 4 (or a cross tee having an aperture 170 through the central web 104) receives end connectors 124, 126 of respective first and second cross tees 102, 102 that connect to each other, such as by respective locking tabs 160, 162 engaging the edges in the respective punch outs for tabs 156, 158.

Figure 7:
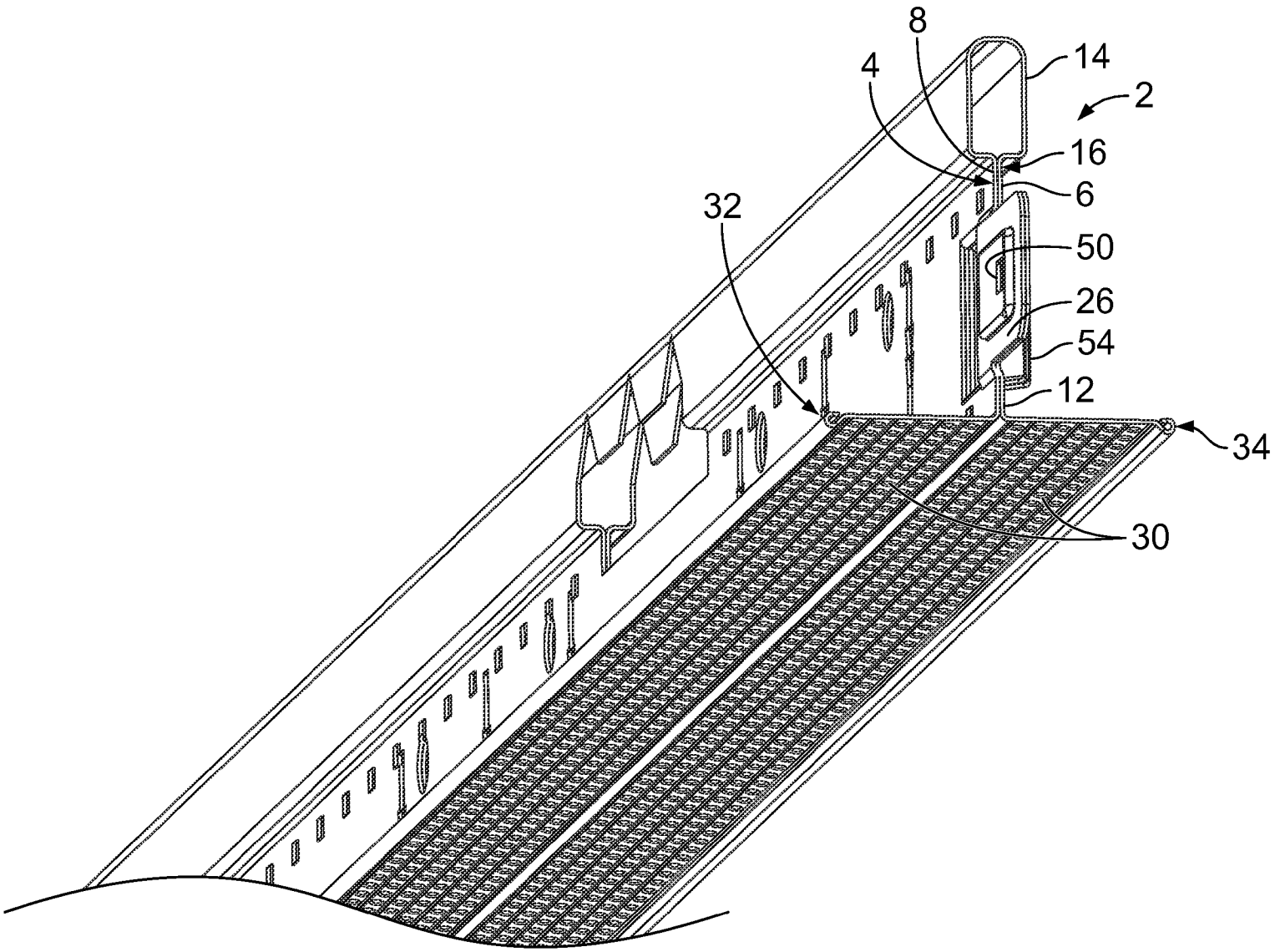
FIG. 7 is a lower perspective view of the first example support member of FIG. 1

It will be appreciated that the knurled lower surface 30 of the support members 2, best seen in FIG. 7, helps to prevent a self-tapping screw from wandering across the lower surface 30 of the flanges 18, 20. It will be appreciated that the knurled lower surface 30 of the flanges 18, 20 would result in a visible pattern on the upper surface of the flanges, but this is not shown, so as to improve the ease of viewing other features in the figures. The lower surface 130 of the support members 102 also may include the advantageous knurled surface to limit wandering of a screw. However, the knurled lower surface and corresponding pattern that would be on the upper surface of the flanges of the support member 102 also are not shown in the figures, so as to improve the ease of viewing other features of the support members. Thus, both support members 2, 102 may include flanges having knurled lower surfaces to help prevent screws from wandering across or along the lower surface of a flange.

Figure 8A:
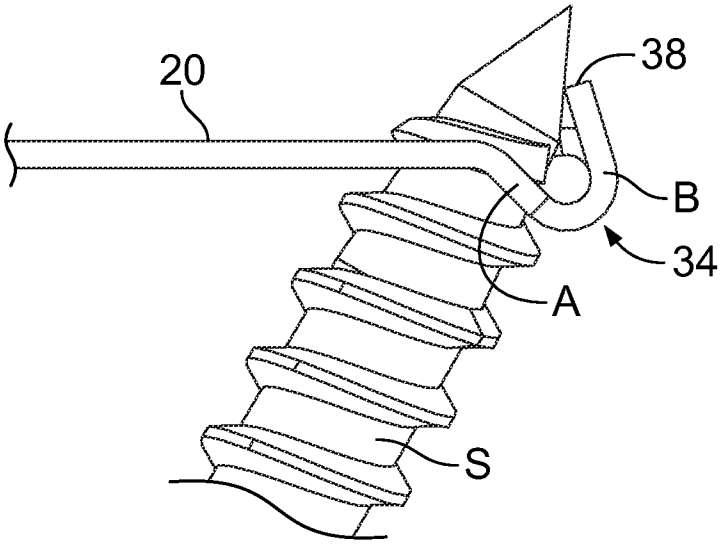
FIG. 8A is an enlarged view of the second screw captured at the outer edge as it pierces through the right flange of the first example support member of FIG. 8.
Figure 8:
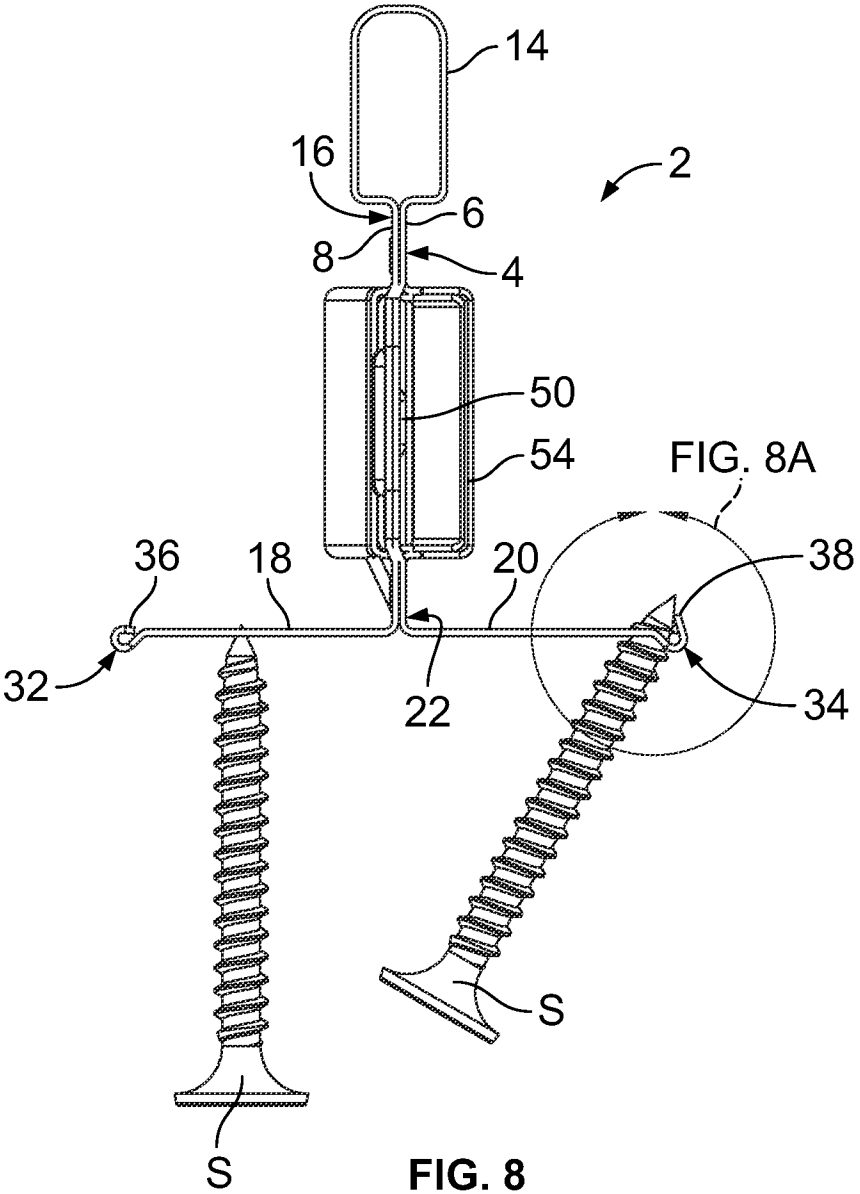
FIG. 8 is an end view of the first example support member of FIG. 1 showing a first screw centrally located relative to the left flange and a second screw captured at the outer edge as it pierces through the right flange.
Figure 9:
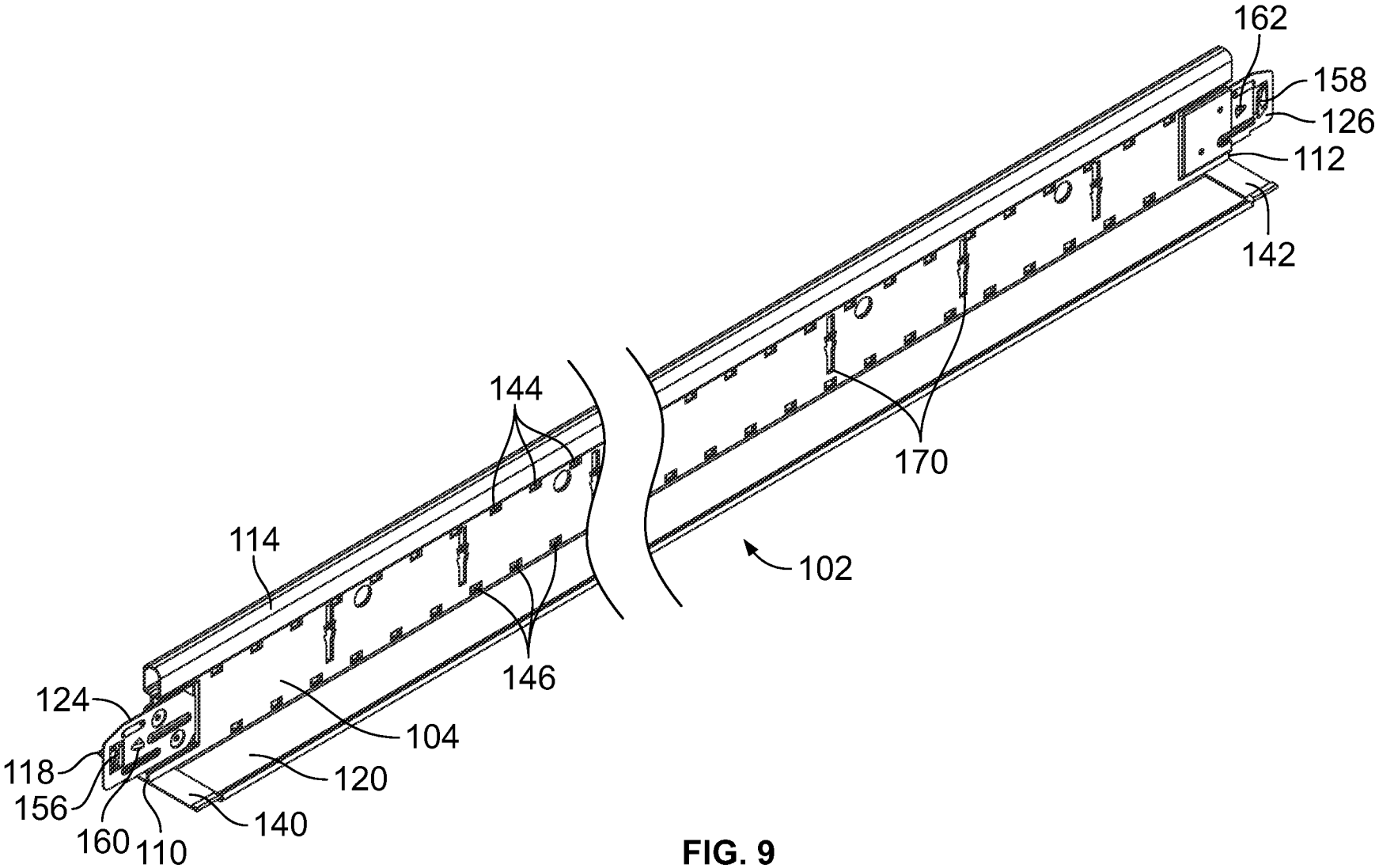
FIG. 9 is a perspective side view of a second example support member for a suspended drywall ceiling grid system in the form of a cross tee in accordance with the present disclosure.
Figure 10:
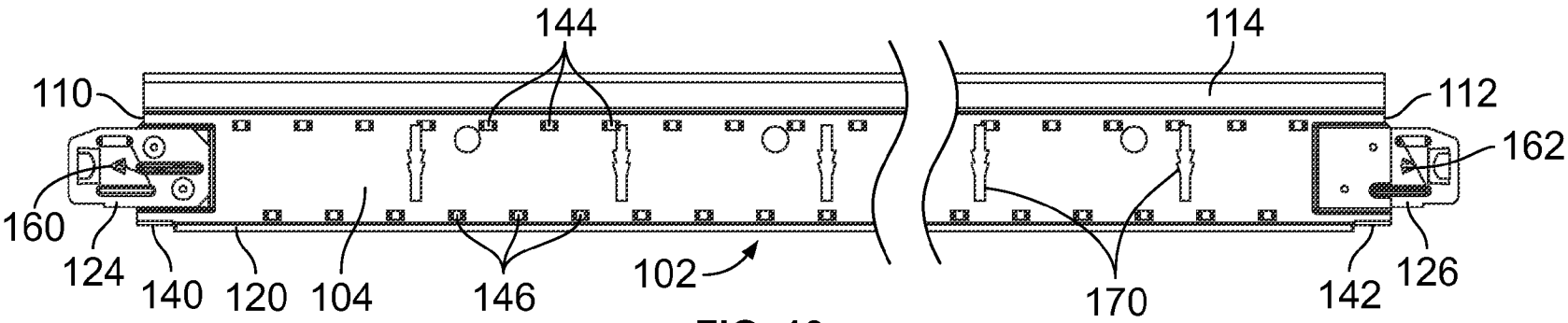
FIG. 10 is a side view of the second example support member of FIG. 9.
Figure 11:
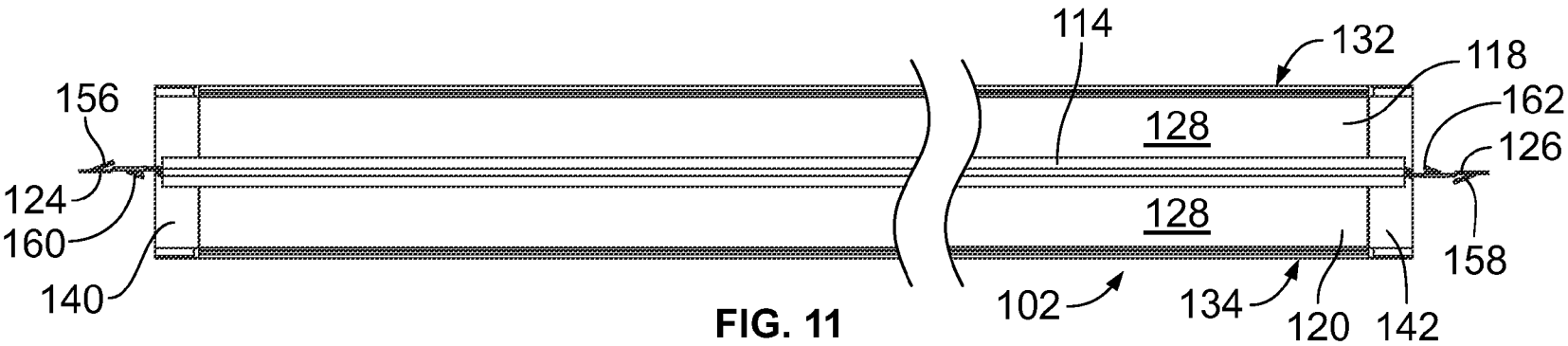
FIG. 11 is a top view of the first example support member of FIG. 9.
Figure 12:
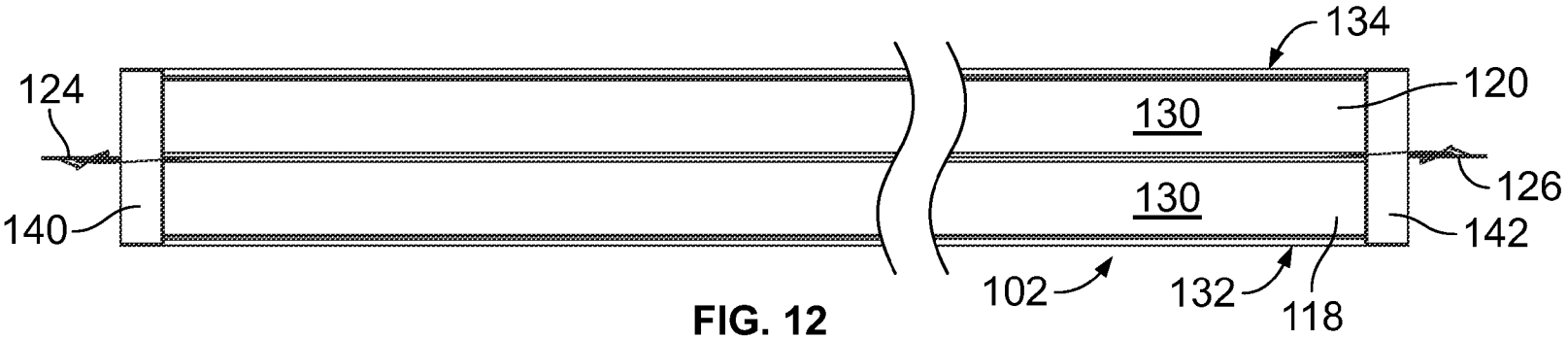
FIG. 12 is a bottom view of the second example support member of FIG. 9.
Figure 14:
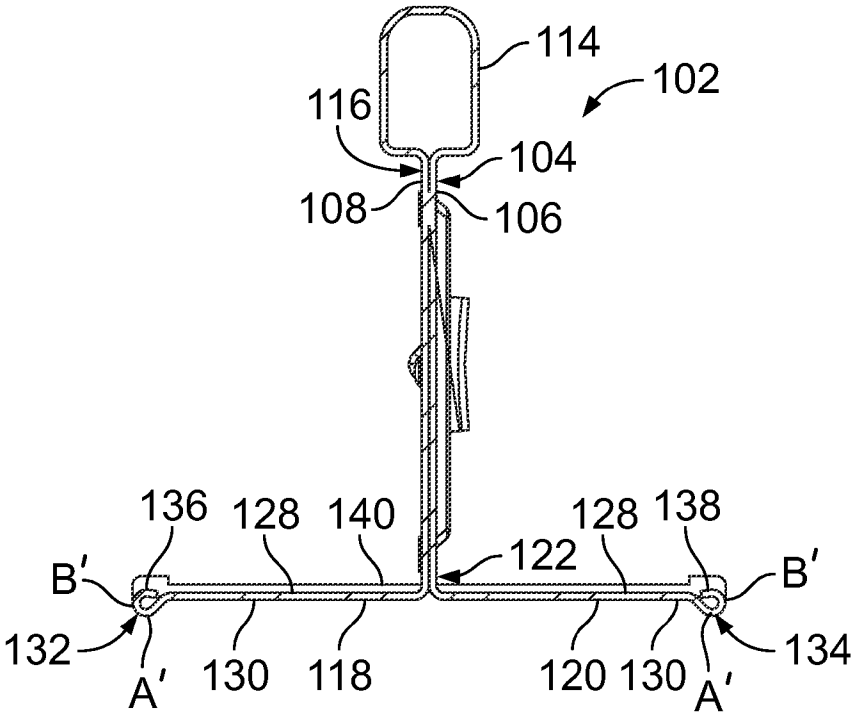
FIG. 14 is a cross-sectional view of the second example support member of FIG. 9.
Figure 13:
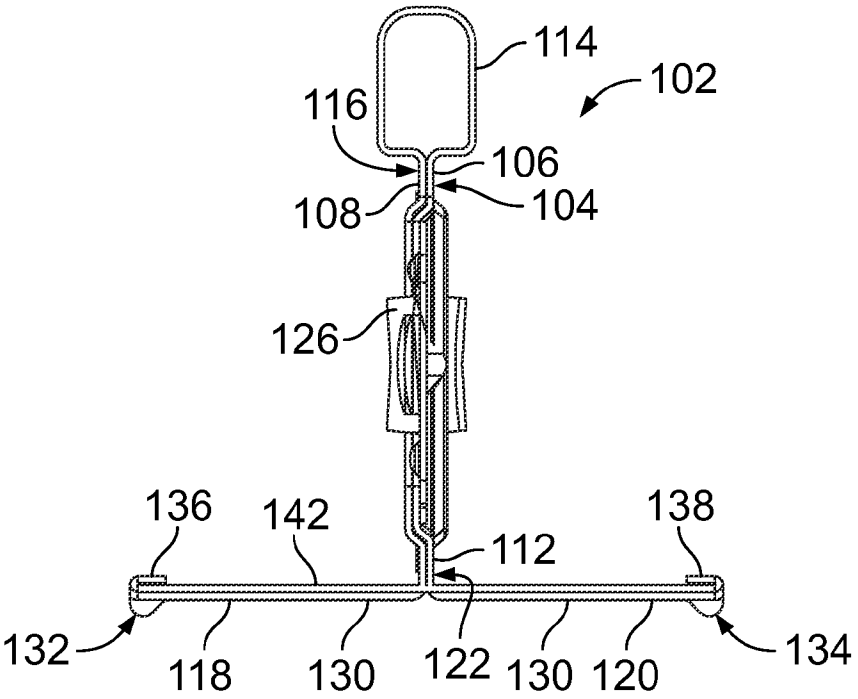
FIG. 13 is an end view of the second example support member of FIG. 9.
Figure 15:
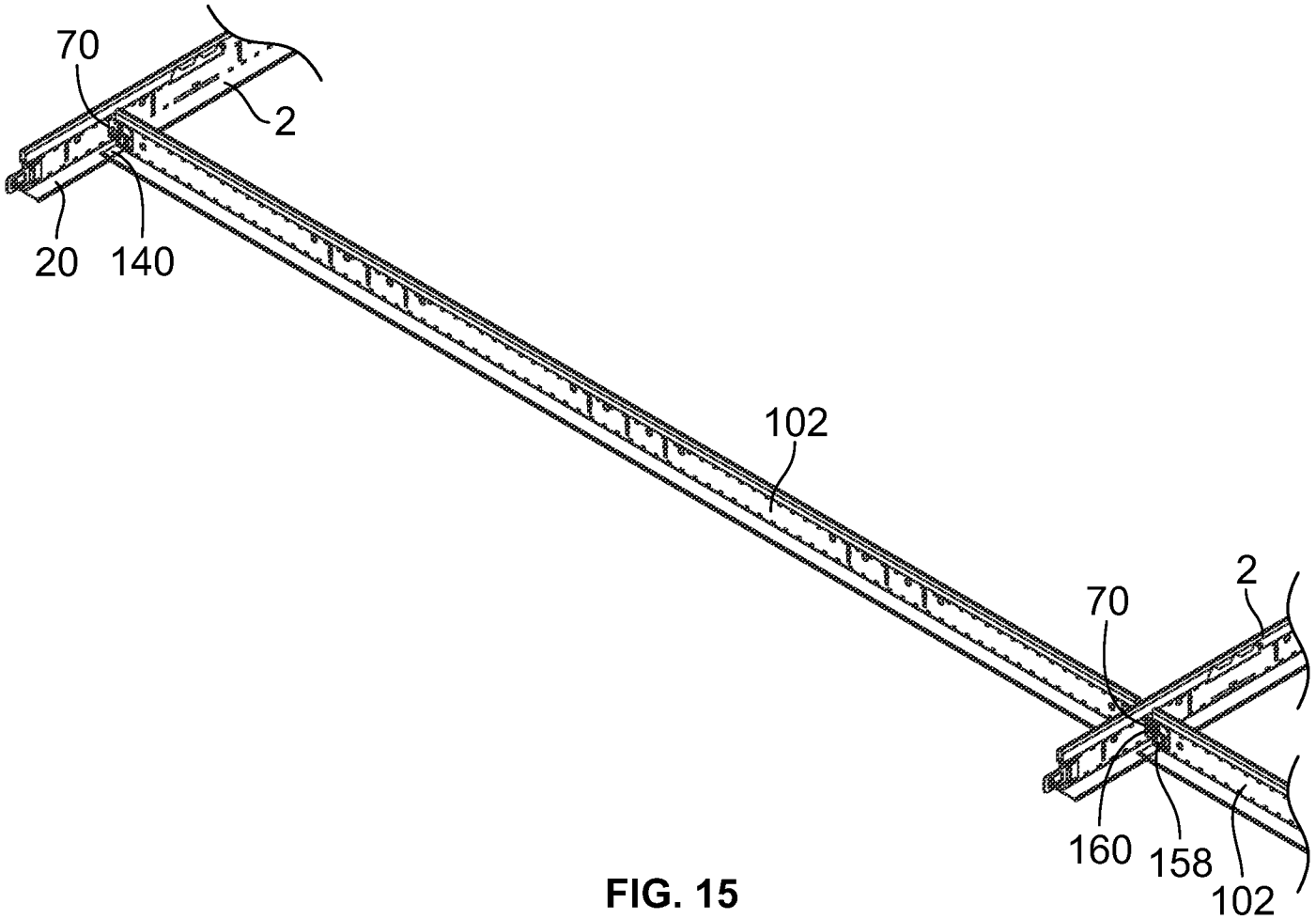
FIG. 15 is a partial upper perspective view of an assembly of two of the second example support members of FIG. 9 connected to two of the first example support members of FIG. 1.

As further shown in FIGS. 8 and 8*a*, the unique rolled edge portion 34 of the flange 20 of support member 2 (representative of the rolled edge portions 32, 34, 132, 134 of the respective flanges 18, 20, 118, 120) is particularly helpful with respect to increasing the likelihood of stopping a self-tapping screw from wandering off an outer edge of a flange. In fact, the added rigidity of the rolled edge portion 34 resists having the screw S bend the outer edge upward, which would otherwise potentially permit the screw to avoid piercing the flange 20.

In addition, having the outer edge 38 of the flange 20 curl downward, outward, upward and then inward first results in the rolled edge portion 34 biasing a rotating screw S to stay on and pierce the flange 20. This structure also provides an added barrier to prevent tear through of the outer edge 38 of the flange 20 because if the screw S pierces the flange 20, the outer edge 38 itself provides final biasing of the screw S to stay within the flange 20 as it pierces the flange 20 and threadably secures a drywall sheet to the flange 20 of the support member 2. It will be appreciated that the structure of this advantageous screw stop feature is able to be utilized with both the support members 2, 102 and their respective flanges 18, 20, 118, 120, so as to provide well connected, relatively rigid runners and cross tees that are likely to yield a higher percentage of successful screw to flange engagements during installation.

Figure 16:
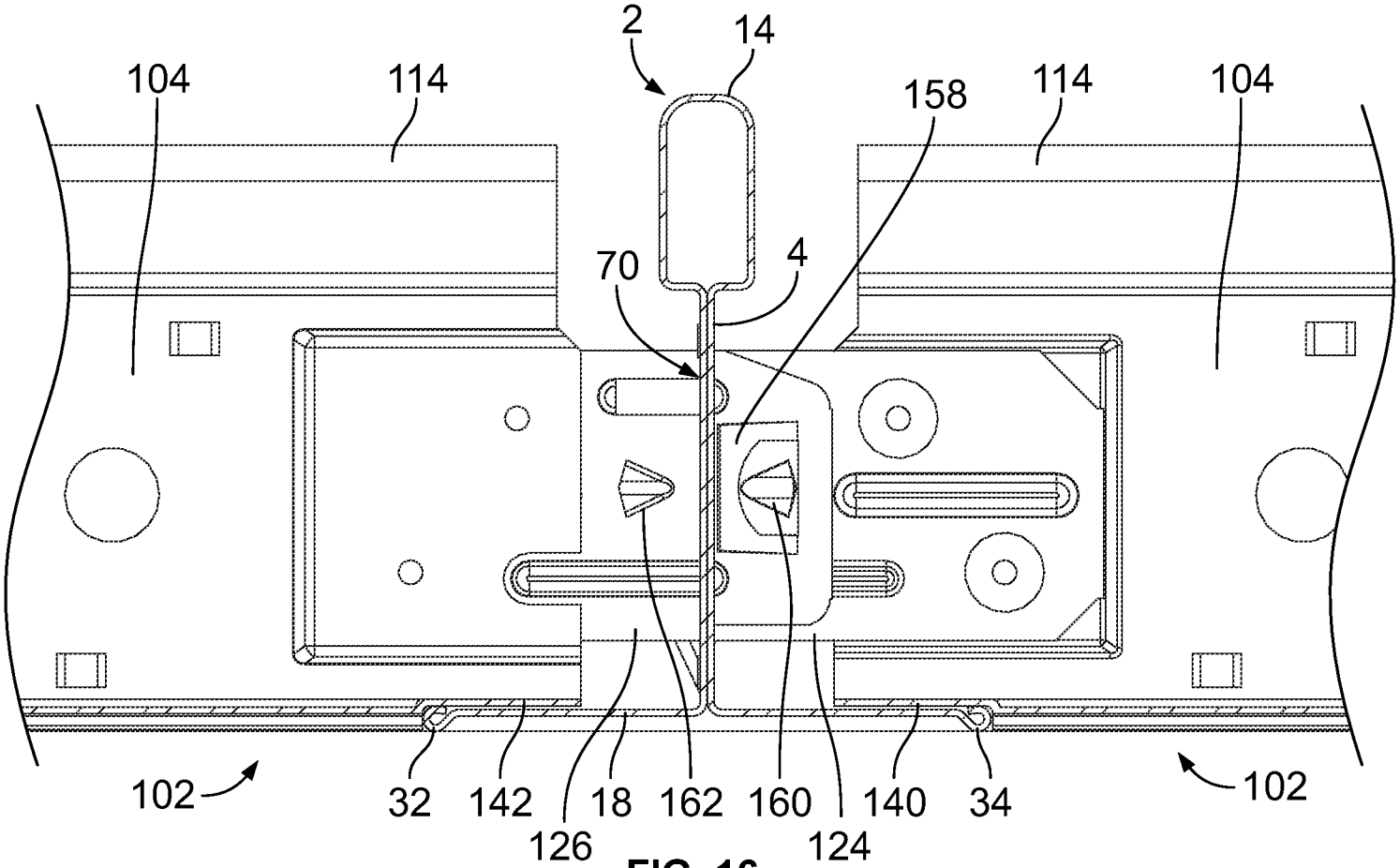
FIG. 16 is a cross-sectional side view of a connected assembly of the ends of two of the second example support members of FIG. 9 extending through an aperture in one of the first example support members of FIG. 1.
Figure 17:
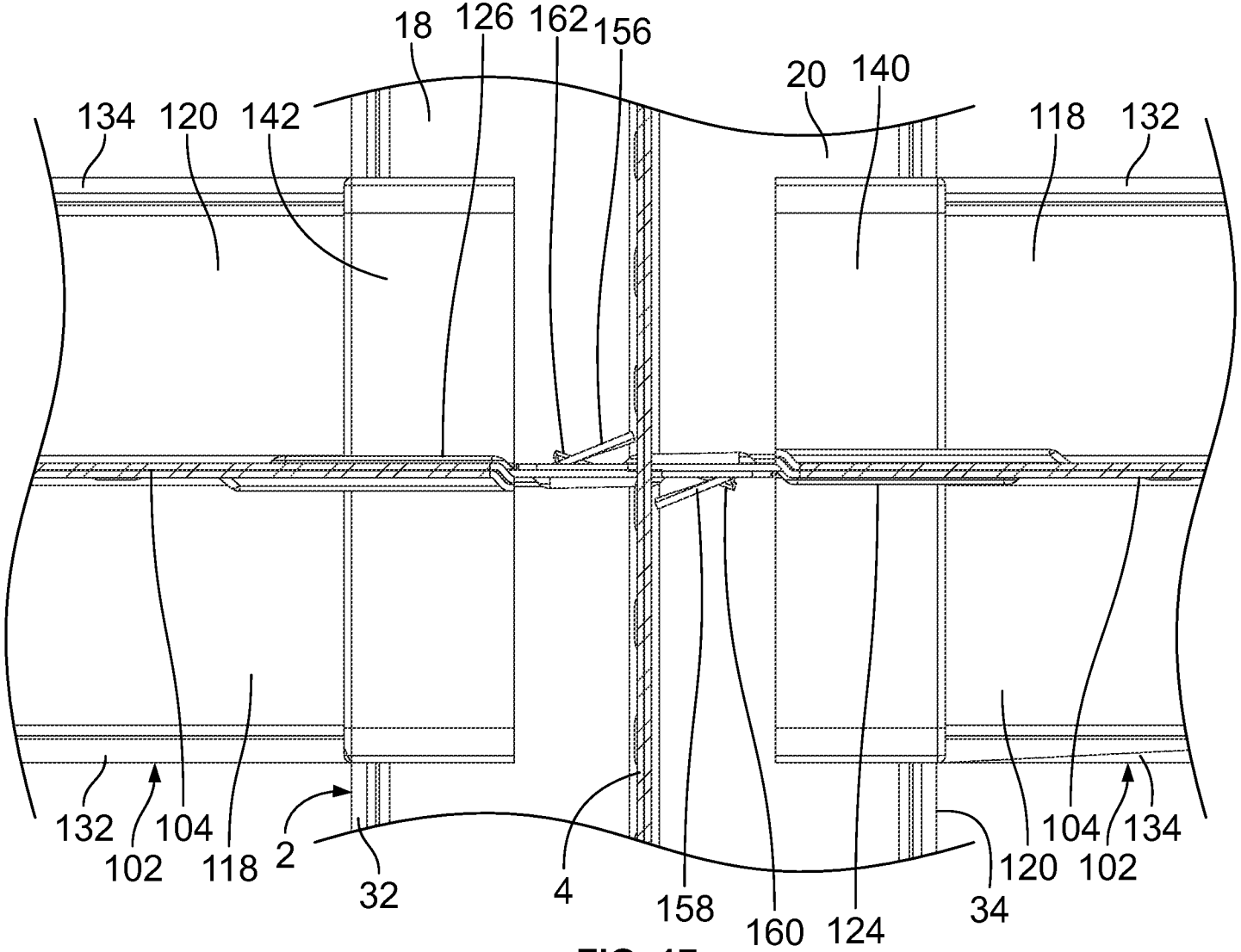
FIG. 17 is a cross-sectional top view of the connected assembly of FIG. 16.

FIGS. 16-17 illustrate cross-sectional side and top views of an intersection of a pair of cross tees 102 and a single runner 2, which may commonly be found in an assembly of a suspended drywall ceiling grid. The connector ends 124, 126 that are connected to the central webs 104 of the cross tees 102 extend through an aperture 70 in the central web 4 of the runner 2, to thereby connect the three support members. The views show that the raised portions 140, 142 of the respective flanges 118, 120 of the cross tees 102 rest atop the flanges 18, 20 of the runner 2.

Figure 18:
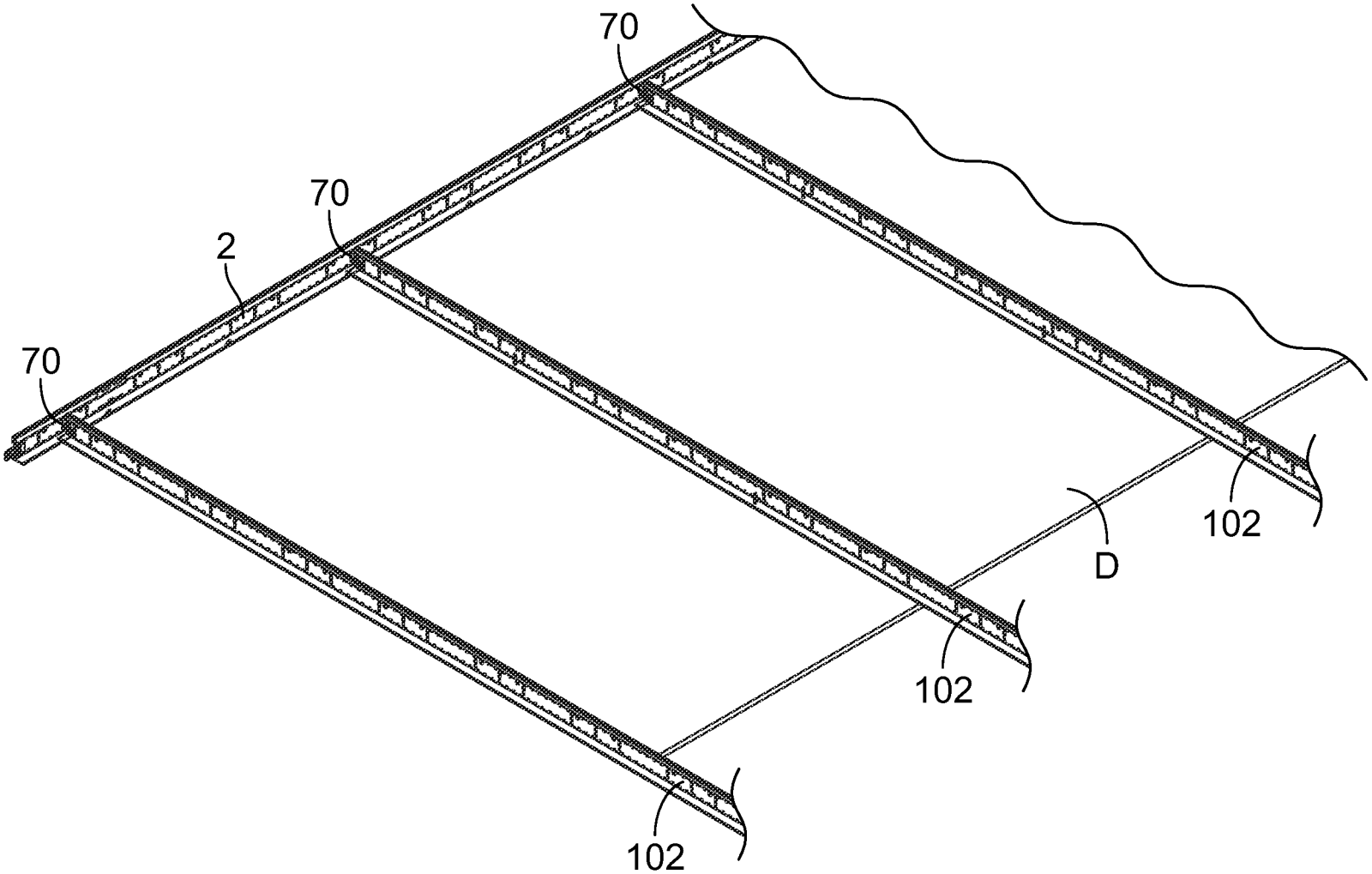
FIG. 18 is a partial upper perspective view of an assembly of three of the second example support members of FIG. 9 connected to one of the first example support members of FIG. 1 for a suspended ceiling grid system, and an example drywall sheet is raised to the underside of the grid system, in accordance with the present disclosure.

It will be appreciated that many configurations for use as a suspended drywall ceiling grid system may be utilized by combining the support members 2, 102 disclosed herein, while providing consistent structural integrity and superior screw engagement. A few representative views of grid systems and relative drywall placement are provided in FIGS. 18-20. For example, FIG. 18 shows a partial upper perspective view of an assembly of three of the example support members 102 in the form of cross tees that are connected to one example support member 2 in the form of a runner as part of a suspended ceiling grid system. In this example, a drywall sheet D is located in a raised position where it is adjacent the underside of the grid system, in contact with the lower surface 30, 130 of the support members 2, 102. The end connectors 124, 126 of the support members 102 extend through apertures 70 to connect to the support member 2 to be held in engagement with the support member 2 by tabs 156, 158, and held in engagement with each other by locking tabs 160, 162.

Figure 19:
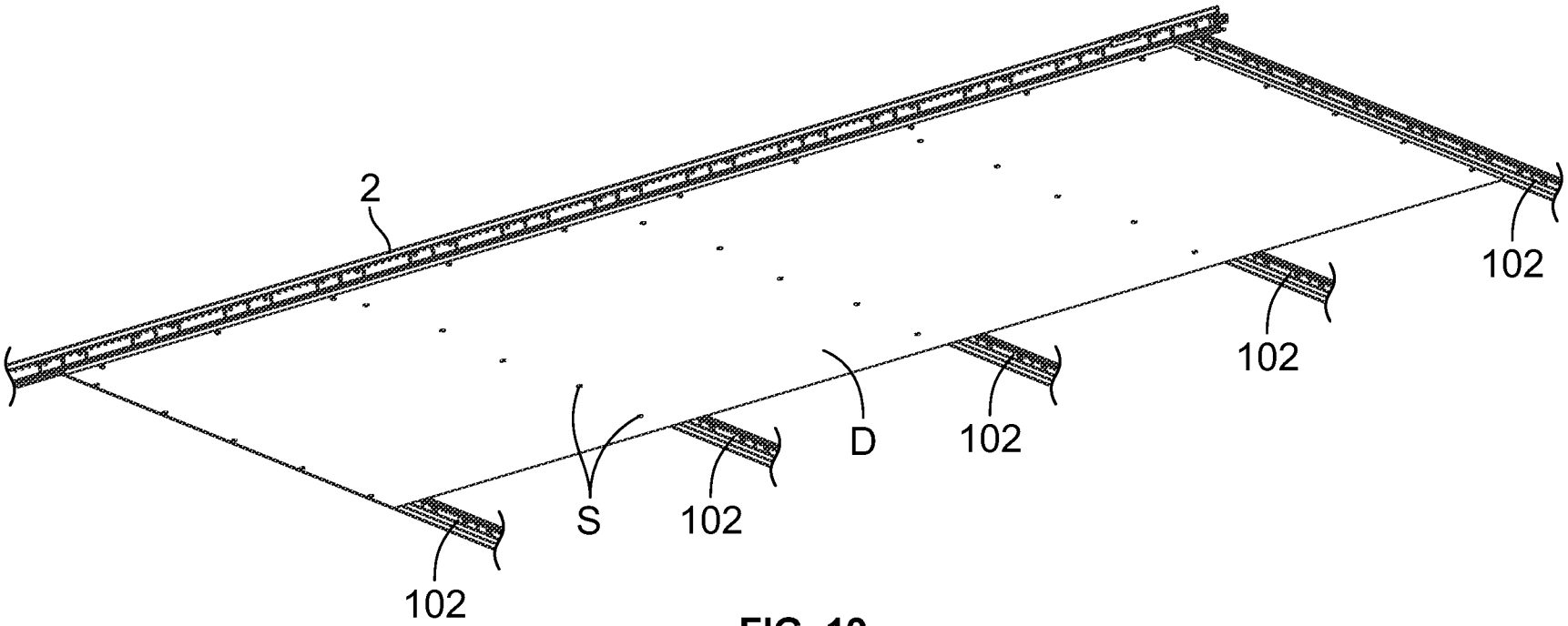
FIG. 19 is a partial lower perspective view of an assembly of a drywall sheet secured to five of the second example support members of FIG. 9 that are connected to one of the first example support members of FIG. 1, in accordance with the present disclosure.

FIG. 19 provides a partial lower perspective view of an assembly of a drywall sheet D secured by screws S to five example support members 102 that in turn are connected to one example support member 2.

Figure 20:
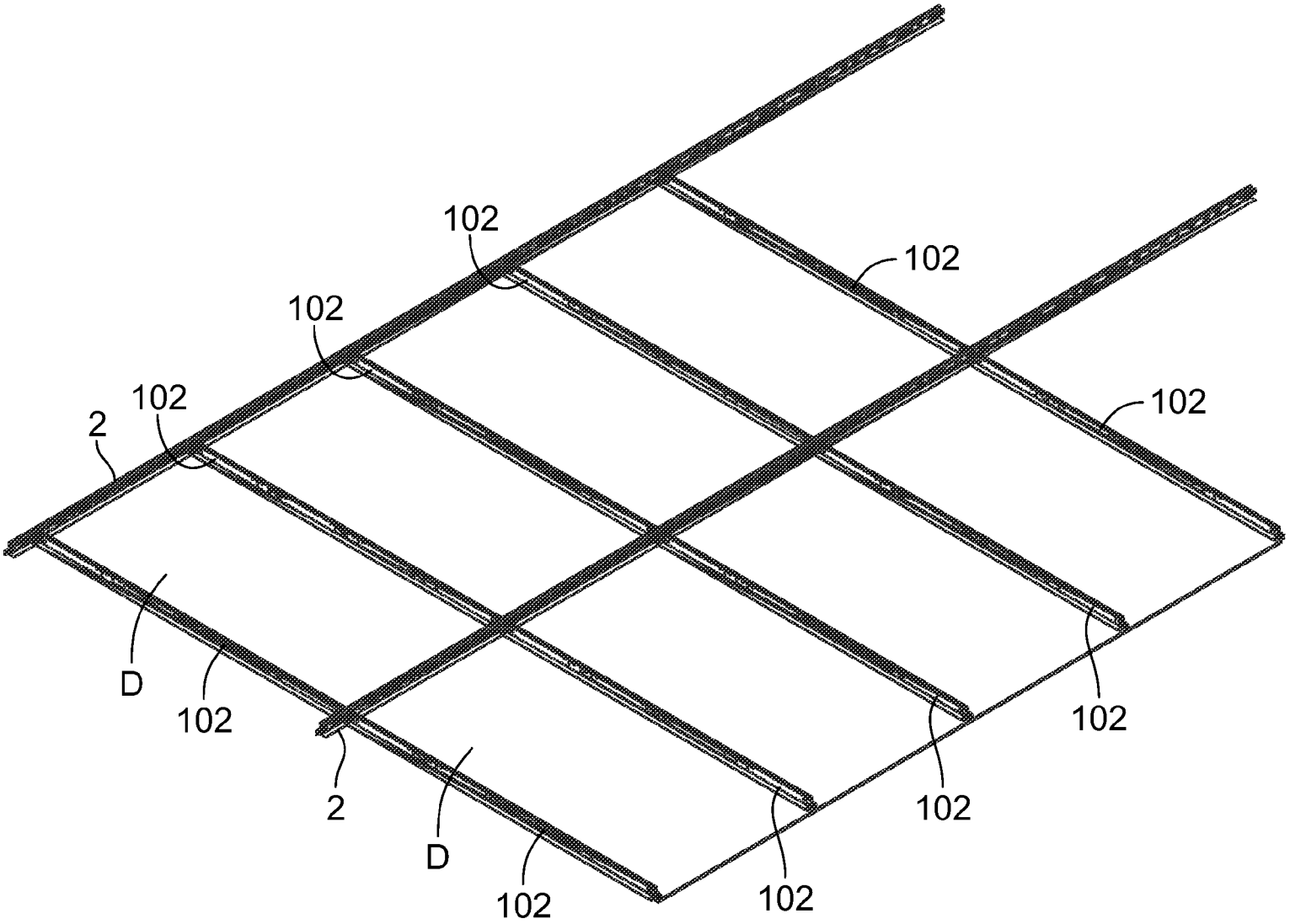
FIG. 20 is a partial upper perspective view of an assembly of ten of the second example support members of FIG. 9 connected to two of the first example support members of FIG. 1 for a suspended ceiling grid system, and two example drywall sheets are raised to the underside of the grid system, in accordance with the present disclosure.

It will be appreciated that FIG. 20 is a further partial upper perspective view of an assembly of ten of the example support members 102 that are connected to two of the example support members 2 for use as a portion of a suspended ceiling grid system. In this view, two example drywall sheets D have been raised to the underside of the grid system, with each spanning the distance between five support members 102. The drywall sheets would be brought into contact with the lower surface 30, 130 of the support members 2, 102 for installation of screws to secure the drywall sheets D to the grid system.

Thus, improved support members for use in a suspended drywall ceiling grid system have been provided. While the support members have been described in terms of certain preferred embodiments, there is no intent to limit the invention to the same. Instead, the invention is defined by the scope of the following claims.

What is claimed is:

1. A support member for a suspended drywall ceiling grid system comprising:

a central web formed of two layers of sheet metal having first and second ends;

a reinforcement bulb extending from an upper portion of the central web between the first and second ends;

opposed flanges extending from a lower portion of the central web between the first and second ends;

first and second end connectors integral with the central web and extending from the first and second ends of the central web, respectively, past the flanges;

each of the opposed flanges having an upper surface and a knurled lower surface between the central web and a rolled edge portion; and each rolled edge portion having an initial region tilted downward and outward and extending into a curved region, wherein the curved region is rolled upward and inward and terminates in an outer edge toward the initial region.

2. The support member of claim 1 wherein the support member further comprises a runner or a cross tee.

3. The support member of claim 1 wherein the rolled edge portion of each flange provides a screw stop.

4. The support member of claim 1 wherein the curved region of each respective rolled edge portion terminates in contact with the respective initial region.

5. The support member of claim 1 wherein each rolled edge portion has a top of the curved region substantially coplanar with the upper surface of the respective flange.

6. The support member of claim 1 wherein the support member has an inverted T-shaped cross-section.

7. The support member of claim 1 further comprising a first row of longitudinally spaced stitches at the upper portion of the central web adjacent the bulb and a second row of longitudinally spaced stitches at the lower portion of the central web adjacent the flanges, with the stitches in the first row being staggered relative to the stitches in the second row.

8. The support member of claim 1 wherein each of the first and second end connectors of the support member further comprises a locking tab, with each of the ends of the central web further comprising a strap deformed out of a plane defined by the central web and being located adjacent the end connector, wherein when a similar support member is placed in end-to-end engagement, the respective straps receive the respective end connectors and engage the respective locking tabs.

9. The support member of claim 1 further comprising a runner having an aperture through the central web which receives end connectors of respective first and second cross tees that are connect to each other.

10. The support member of claim 1 wherein each of the first and second end connectors of the support member further comprises a first locking tab extending in a first direction and being configured to engage a respective end connector of a similar support member when placed in end-to-end engagement.

11. The support member of claim 10 wherein each of the first and second end connectors further comprises a second locking tab extending in a second direction opposed to the first direction of the respective first locking tab, and wherein when said support member and similar support member are placed in end-to-end engagement with the respective end connectors extending through an aperture in a central web of a separate perpendicularly disposed support member, the respective second locking tabs engage the central web of the separate perpendicularly disposed support member.

* * * * *